US005079977A

United States Patent [19]

Petrie

[11] Patent Number: 5,079,977

[45] Date of Patent: Jan. 14, 1992

[54] RETAINING RING TOOLS

[76] Inventor: John A. Petrie, 16 Weebetook La., Cincinnati, Ohio 45208

[21] Appl. No.: 540,580

[22] Filed: Jun. 19, 1990

Related U.S. Application Data

[63] Continuation-in-part of Ser. No. 376,705, Jul. 7, 1989, abandoned.

[51] Int. Cl.[5] ..... B25B 7/02

[52] U.S. Cl. ..... 81/123; 81/302; 81/DIG. 5; 29/229

[58] Field of Search ..... 81/302, 423, DIG. 5, 81/427.5; 29/229

[56] References Cited

U.S. PATENT DOCUMENTS

| | | | |
|---|---|---|---|
| 1,422,121 | 7/1922 | Millen | 81/DIG. 5 |
| 2,597,394 | 5/1952 | Snowden . | |
| 3,040,420 | 6/1962 | Kulp | 81/423 X |
| 3,132,550 | 5/1964 | Sion | 81/302 X |
| 3,762,019 | 10/1973 | Epstein . | |
| 3,990,137 | 11/1976 | Kulba et al. . | |
| 4,280,265 | 7/1981 | Murphy . | |
| 4,304,158 | 12/1981 | Brunosson et al. | 81/427.5 |
| 4,476,750 | 10/1984 | Murphy . | |
| 4,621,401 | 11/1986 | Anderson . | |

FOREIGN PATENT DOCUMENTS

| | | | |
|---|---|---|---|
| 2032444 | 1/1972 | Fed. Rep. of Germany | 81/423 |
| 2920841 | 11/1980 | Fed. Rep. of Germany | 81/423 |

OTHER PUBLICATIONS

Rencol Rings Flyer-undated (admitted prior art).

*Primary Examiner*—James G. Smith

*Attorney, Agent, or Firm*—Renner, Otto, Boisselle & Sklar

[57] ABSTRACT

A pair of removable jaws interchangeable between internal and external retaining ring tools, each of the tools including a tool body having a pair of handles pivotally connected together, with bores or openings in the ends of the handles for receipt of stepped cylindrical extensions on the jaws. Preferably, the jaws are made of premium steel, whereas the tool bodies may be either forged using a lesser quality steel or made of even less expensive standard thin wall tubing. Tolerance rings frictionally retain the cylindrical extensions in the bores. The jaws and tool bodies have suitable indicia to index (orient) the jaws relative to the tool handles for both internal and external use.

34 Claims, 5 Drawing Sheets

RETAINING RING TOOLS

CROSS-REFERENCE TO RELATED APPLICATIONS

This application is a continuation-in-part of copending U.S. patent application Ser. No. 07/376,705, filed July 7, 1989, entitled "Retaining Ring Tools", now abandoned.

TECHNICAL FIELD OF THE INVENTION

The present invention relates generally to retaining ring tools and, more particularly, to internal and external ring plier-like tools used commonly in installing and removing internal and external retaining rings.

BACKGROUND OF THE INVENTION

As industry and the engineering arts have progressed, machines and devices have been created demanding increasingly closer tolerances in mating parts. One method of circumventing exceptionally tight tolerance requirements in these parts is to employ retaining rings. Retaining rings are compressed to fit inside a bored hole or cylinder, or expanded to fit around a shaft. Upon assembly the retaining rings create an interference fit between the mating parts at a reasonable cost. The most common method employed to install retaining rings involves using internal or external ring pliers to respectively expand or compress the retaining rings to fit in the required place.

Retaining ring pliers are currently available in a wide variety of styles and sizes, at a range of prices generally corresponding to the quality of material used in their construction. The pliers are usually made of stamped heat treated steel or of a forged material. The stamped pliers are less expensive but tend to be fragile and break easily. The forged pliers offer less breakage but are expensive.

Convertible pliers are also available in the industry. These pliers have removable jaws which may be interchanged to make the pliers work in different situations. This permits a single pair of pliers to be converted to perform multiple functions by simply removing the jaws and replacing them with a separate set of jaws. These pliers may be available with several separate sets of jaws, each specially suited to a separate and distinct application.

It would be desirable to develop a convertible style of retaining ring tools that is less expensive than premium steel forged tools, yet strong and with jaws that are easily replaceable and interchangeable between tool bodies.

SUMMARY OF THE INVENTION

In accordance with the present invention, retaining ring tools are provided with lower quality tool bodies and higher quality replaceable jaws to greatly improve their useful life. The jaws are assembled into holes or openings in the ends of the tool bodies and secured by means of tolerance rings. In one form of the invention, the tool bodies are made of a lower quality steel, whereas in another form of the invention the tool bodies are made of standard thin wall tubing.

Further in accordance with the present invention, the jaws are desirably freely interchangeable for both external and internal retaining ring tool configurations. The jaws and tool handles include suitable indicia to indicate correct orientation of the jaws relative to the tool handles with respect to either internal or external use. In a preferred form of the invention, a single jaw configuration is provided, with suitable indicia thereon which may either consist of one or more markings that are lined up with other markings on opposite sides of the tool handles or a single key or flat on one side of each jaw that is engageable with a corresponding keyway or flat on opposite sides of the tool handles to properly index or orient the jaws with respect to the tool handles. The use of keys and keyways or flats as indicia have the added benefit of providing additional resistance to torsional forces.

These and other objects, advantages, features and aspects of the present invention will become apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principals of the invention may be employed.

DETAILED DESCRIPTION OF THE PREFERRED EMBODIMENTS

Figure 1:
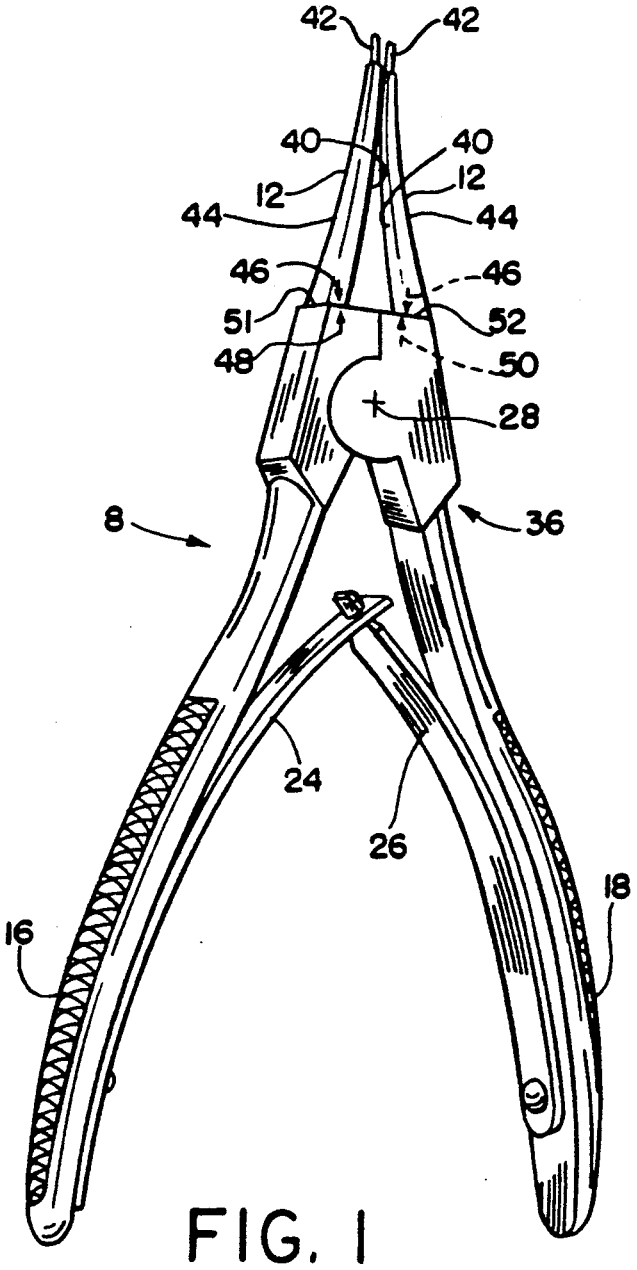
FIG. 1 is a perspective view of an external ring tool with replaceable jaws in accordance with the present invention.
Figure 2:
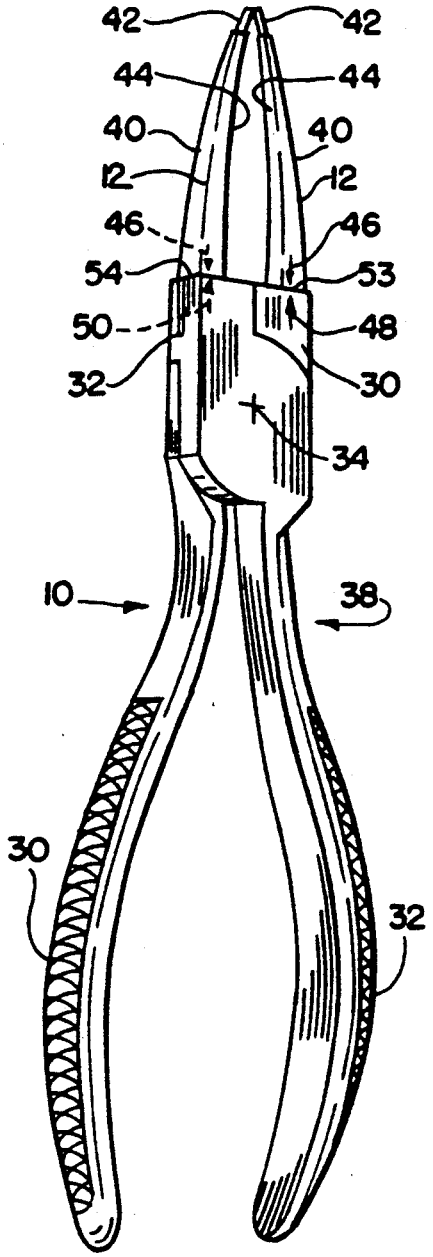
FIG. 2 is a perspective view of an internal ring tool with replaceable jaws in accordance with the present invention.

Referring to the several figures wherein like reference numerals depict like parts, and initially to FIGS. 1 and 2, there is shown two different types of retaining ring tools 8, 10 with interchangeable jaws 12 in accordance with the present invention. The general design of the tool bodies are typical to plier designs well known in the art, as will be appreciated from the description below. The invention thus primarily lies in the design of the jaws, their relation and assembly to the tool bodies, and modifications to the tool bodies.

FIG. 1 illustrates an external retaining ring tool 8. The tool 8 basically includes a pair of handles 16, 18 and a pair of replaceable jaws 12 for engagement with an external retaining ring (not shown). The jaws 12 may be substantially identical so that they are freely interchangeable as described hereafter. Disposed between the handles 16, 18 is a set of leaf springs 24, 26 to cause the jaws to rest in a closed position absent an outside force. The handles 16, 18 are coplanar and pivotally movable about a fixed common axis 28. The design of the handles 16, 18 is such that a force exerted on the handles will be transferred through the pivot 28 to the jaws 12 so as to act with equal magnitude in the opposite direction. Therefore, squeezing the handles 16, 18 will cause the jaws 12 to open and exert a force in a relatively outwardly direction. When used in conjunction with an external retaining ring (not shown), a pressure exerted on the handles 16, 18 will cause the jaws 12 to move outwardly thus to expand the retaining ring to the degree necessary for installation or removal.

FIG. 2 is an illustration of an internal retaining ring tool 10. The tool 10 also includes a pair of coplanar handles 30, 32 pivotally movable around a fixed common axis 34, and a pair of jaws 12 which may be substantially identical to the jaws 12 shown in FIG. 1 thus making them freely interchangeable as described hereafter. In this design, however, the handles 30, 32 cross over each other so as to be operable in a scissor-like fashion. Therefore a force exerted on the handles 30, 32 will be transferred through the pivot 34 to the jaws 12 with the same magnitude but in the opposite direction. Squeezing the handles 30, 32 will then cause the jaws 12 to close and exert a force in a relative inwardly direction. When employed in conjunction with an internal retaining ring (not shown), a force exerted on the handles 30, 32 will cause the jaws 12 to move inwardly thus contracting the overall diameter of the ring sufficient for installation or removal.

The tool handles 16, 18 and 30, 32, being relatively heavy, may be constructed of relatively inexpensive low quality forged steel which will withstand the stresses developed in the tool bodies during use of the tools without breaking. The tool jaws 12, on the other hand, are much thinner and more subject to abuse. Therefore, to minimize breakage of the jaws 12 (including the reduced diameter tips 42 at the outer ends of the jaws), they are made of a more expensive, premium forged steel such as chrome-vanadium. Since the greatest stresses in the tools are generally developed in the jaws, employing the stronger material there and generally weaker, less expensive steel in the handles reduces the cost of the tools while enhancing their strength and resistance to breakage.

Hereinafter the two handles of each tool are sometimes conjunctively referred to as a tool body for ease of description. The handles 16, 18 of the external ring tool 8 of FIG. 1 thus form tool body 36 and the handles 30, 32 of the internal ring tool 10 of FIG. 2 form tool body 38.

Referring specifically to the external ring tool 8 of FIG. 1, the jaws 12 are desirably substantially identical including a generally slightly curved shape. However, their orientations are reversed on the respective tool handles 16, 18 with their outer (convex) curved surfaces 40 opposing (facing) each other so that the correspondingly curved tips 42 sweep slightly outward to pick up the ring holes of an external retaining ring.

Referring to FIG. 2, the jaws 12 of the internal ring tool 10 are desirably substantially identical to the jaws 12 of FIG. 1 as previously described but are oriented oppositely with their inner (concave) curved surfaces 44 facing each other so that the correspondingly curved tips 42 sweep slightly inward to facilitate picking up the ring holes of an internal retaining ring.

The jaws 12 are provided with suitable indicia such as a single downwardly extending arrow 46 on one side, which when aligned with corresponding indicia such as a single upwardly extending arrow 48, 50 on opposite sides of the respective tool handles 16, 18 and 30, 32, will correctly index (orient) the jaws with the tool handles and facilitate proper installation of the jaws in the end faces 51, 52 and 53, 54 of the tool handles. The markings 48, 50 and 46 may be stamped, engraved, etched, or otherwise permanently made in the tool handles and jaws, respectively.

Figure 3:
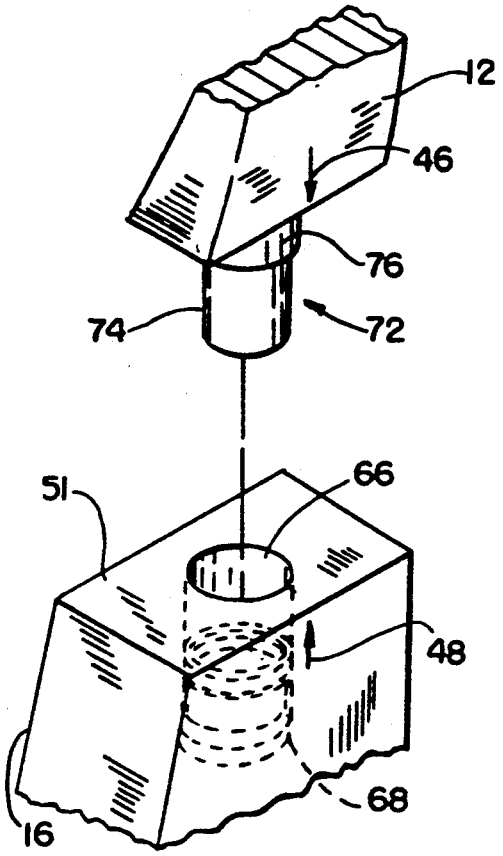
FIG. 3 is an enlarged fragmentary exploded view of one of the tool handles and jaws of FIG. 1 indicating their mating surfaces.
Figure 4:
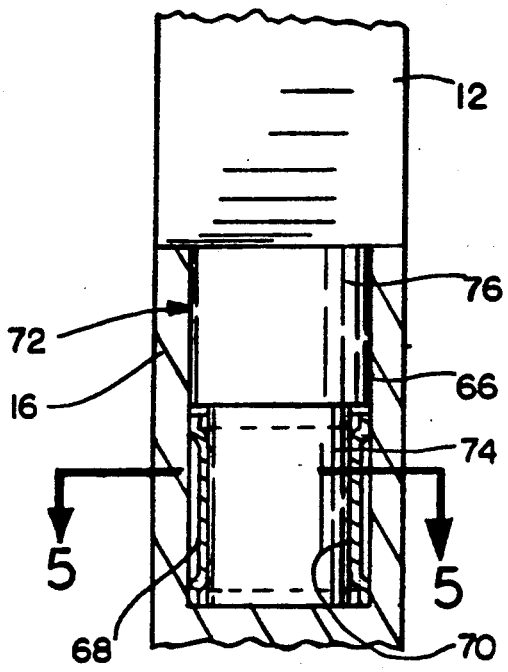
FIG. 4 is an enlarged fragmentary longitudinal section through the tool handle and jaw of FIG. 3 after assembly.
Figure 5:
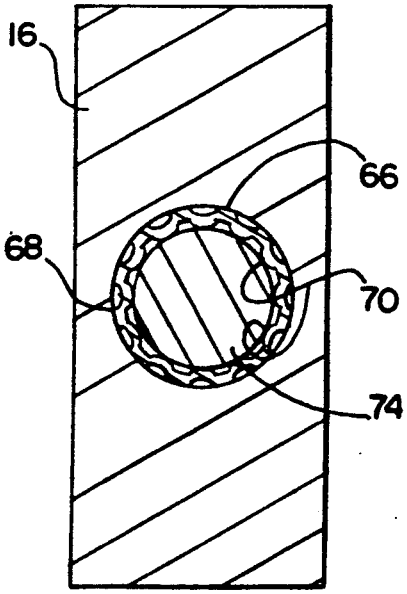
FIG. 5 is a transverse section through the tool handle and jaw of FIG. 4, taken generally on the plane of the line 5—5 thereof.

In the preferred embodiment, a plurality of jaws 12 each having substantially the identical configuration are interchangeable with both the external and internal ring tools 8 and 10. Therefore if the external ring tool 8 has, for example, a single arrow marking 48 on one side of the tool handle 16 adjacent the end face 51 and a single arrow marking 50 on the opposite side of the tool handle adjacent the end face 52, the internal ring tool 10 may similarly have a single arrow marking 48 on the same side of the tool handle 30 adjacent the end face 53 and a single arrow marking 50 on the opposite side of the tool handle 32 adjacent the end face 54. Interchanging the jaws 12 thus requires taking the right jaw 12 from the external tool 8 in FIG. 1, and inserting it into the left side of the internal tool 10 as shown in FIG. 2; correspondingly, the opposite would be done with the other jaw 12. Of course, it should be understood that any of the jaws 12 could be inserted into either handle of either tool 8, 10 simply by rotating the jaws to bring the indicia on the respective jaws and handles into proper alignment with each other.

Where each of the handles 16, 18 and 30, 32 forms the end faces 51, 52 and 53, 54 of the tool bodies 36, 38 there is provided a constant diameter bore 66 in each end face for engagement by a jaw. One such handle 16 and respective end face 51 is shown in FIGS. 3–5. Inserted into the deepest portion of each bore 66 is a corrugated tolerance ring 68 for securing the inserted jaw 12 (see FIGS. 4 and 5). The tolerance ring 68 may be of the type sold by EPP Inc. under the trademark RENCOL RINGS, and includes a plurality of circumferentially spaced corrugations 70 each of which acts as an individual spring between which a stepped diameter cylindrical extension 72 on the jaws may be forced to accomplish a tight fit. When the extension 72 on one of the jaws 12 is completely inserted into the bore 66, the smaller diameter portion 74 will engage with the spring-like corrugations 70 to form a tight tolerance fit therebetween and the larger diameter portion 76 will closely mate with the bore 66 diameter above the tolerance ring 68 to provide additional support for the jaw in the bore 66 as shown in FIGS. 4 and 5 so that the jaws 12 do not wobble with respect to the tool handles during use of the tools. The interference fit between the extension portion 74 and the compressible corrugations 70 of the ring 68 are such that the jaws 12 may be installed or removed by applying only moderate force in the vertical direction.

Figure 6:
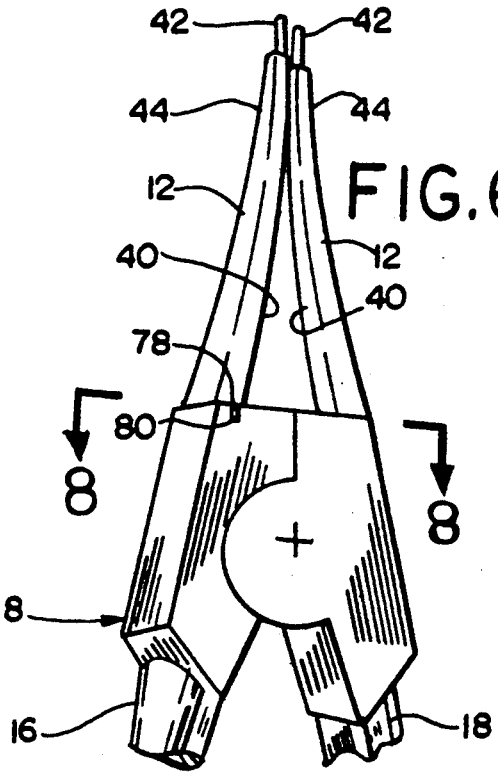
FIG. 6 is a fragmentary perspective view of a modified form of external ring tool with keyed jaws.
Figure 7:
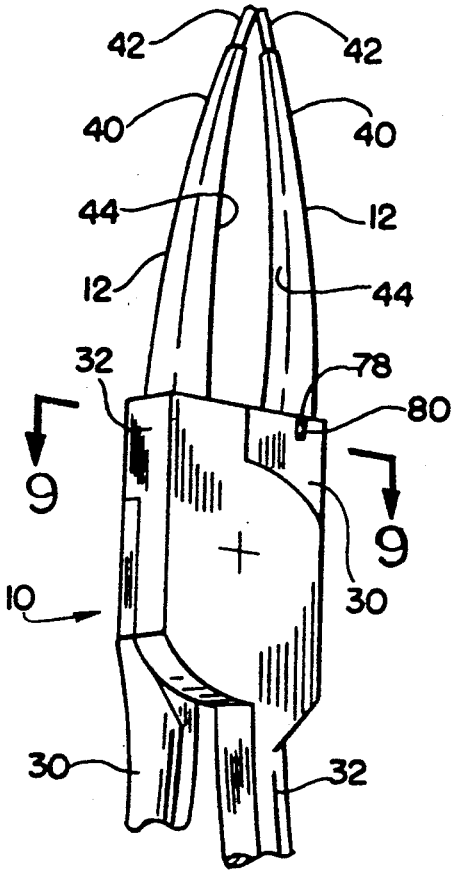
FIG. 7 is a fragmentary perspective view of a modified form of internal ring tool with keyed jaws.
Figure 10:
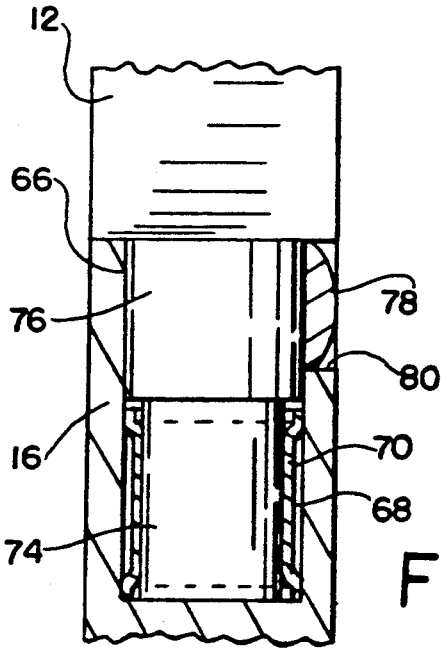
FIG. 10 is an enlarged fragmentary longitudinal section through the left hand tool handle and jaw of FIG. 6.

For the larger tool sizes, the larger diameter portion 76 of each jaw extension 72 may be provided with a small key or tab 78 on one side for insertion into a correspondingly shaped slot or keyway 80, 82 intersecting the respective bores 66 on opposite sides of the respective tool handles. The keys or tabs 78 may be formed on the larger diameter portion 76, for example, by a simple crimping or upsetting operation. The slots or keyways 80, 82 terminate short of the retaining ring 68 as shown in FIG. 10, and when engaged by the key 78, prevent rotational movement of the jaws 12 relative to the tool bodies under torsional loading. FIGS. 6, 7 and 10 show keyed jaws 12 inserted into the tool handles with suitable keyways. In this instance, the keys 78 and keyways 80, 82 on the respective jaws 12 and tool handles 16, 18 and 30, 32 also act as suitable indicia to provide the correct indexing or orientation of the jaws relative to the tool handles with respect to either internal or external use by locating the slots 80, 82 on opposite sides of the tool handles as schematically shown in FIGS. 6–9.

The tolerance rings 68 shown in FIGS. 3 through 5 and 10 are of the internal type, that is, they are inserted into the bores 66 in the tool bodies 36, 38 to frictionally retain the jaws 12 in place. However, it will be appreciated that external tolerance rings (not shown) may be used in place of the internal tolerance rings. External tolerance rings would operate in a manner similar to the internal tolerance rings except that they would be mounted on the smaller diameter jaw extensions 74 prior to insertion into the bores 66 for frictionally retaining the jaw extensions within the bores.

Figure 8:
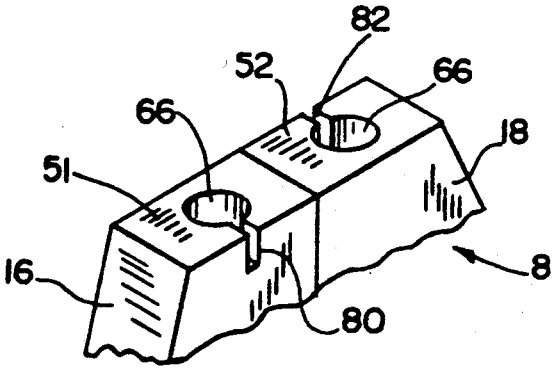
FIG. 8 is a fragmentary perspective view of the end faces of the external ring tool of FIG. 6 taken along the plane of the line 8—8 thereof.
Figure 9:
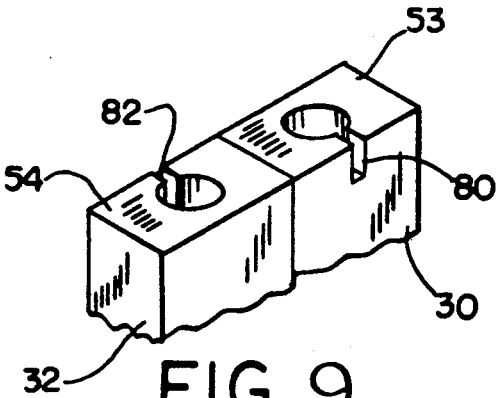
FIG. 9 is a fragmentary perspective view of the end faces of the internal ring tool of FIG. 7 taken along the plane of the line 9—9 in FIG. 7.

FIG. 8 shows the end faces 51, 52 of the tool handles 16, 18 for the external ring tool 8 of FIG. 6 with the left keyway 80 on one side of handle 16 and the right keyway 82 on the opposite side of handle 18. For the internal ring tool 10 of FIGS. 7 and 9 the keyway 80 is on the same side of handle 30 and the keyway 82 is on the opposite side of handle 32. In this instance, the jaws 12 will be easily indexed and aligned correctly by mating the keys and keyways with respect to the proper use. When the jaws 12 are inserted in the external ring tool 8 of FIG. 6, the jaws are seen with the outer curved surfaces 40 opposing each other, whereas when the jaws are removed and interchanged with the internal ring tool 10 of FIG. 7, the jaws are reversed, with the inner curved surfaces 44 facing. The keyed design of the present invention, thus, provides for torsionally rigid jaws that are easily indexed (aligned) and interchangeable between internal and external tool configurations.

For the smaller sizes and in many cases even for the larger sizes, the frictional fit between the jaw extension 74 and the tolerance ring 68 will provide sufficient torsional resistance to prevent rotation whereby the keys 78 and keyways 80, 82 are not necessary. In this embodiment the jaws 12 and tool handles 16, 18 and 30, 32 are formed as shown in FIGS. 1–5 without the keys and keyways. However, it will be apparent that the unkeyed jaws may be used in tool bodies with or without the keyways. The proper orientation and alignment of the jaws and tool handles is accomplished by aligning the previously described markings 46 on the jaws with the markings 48, 50 or keyways 80, 82 on the tool handles. This embodiment should reduce the cost of the jaws and tool bodies since the cost of forming the keys and keyways are eliminated and overall production time should be decreased.

FIGS. 11 through 17 show several additional retaining ring tool embodiments of the present invention in which the tool handles, rather than being forged out of a lower quality steel, are formed out of standard thin wall tubing to make the tools even less expensive. The tubing used to form the handles 86, 87 and 88, 89 of both the internal ring tool 90 shown in FIG. 11 and the external ring tool 91 shown in FIG. 16 may, for example, be 5/16 inch tubing with a wall thickness of approximately 0.042 inch.

The respective handles 86, 87 and 88, 89 may be pivotally connected together by providing each of the handles with a flattened portion 92 in respective pivot areas 93 having a length, for example, of approximately 0.084 inch. In the case of the internal retaining ring tool 90 shown in FIG. 11, the tubular handles 86, 87 are shown pivotally connected together by means of a rivet 94 extending through aligned holes 95 in the flattened portions 92. If necessary, a thin heat-treated steel washer (not shown) may be welded to one or both of the flattened portions of the handles 86, 87 before the handles are riveted together for increased wear resistance.

Figure 16:
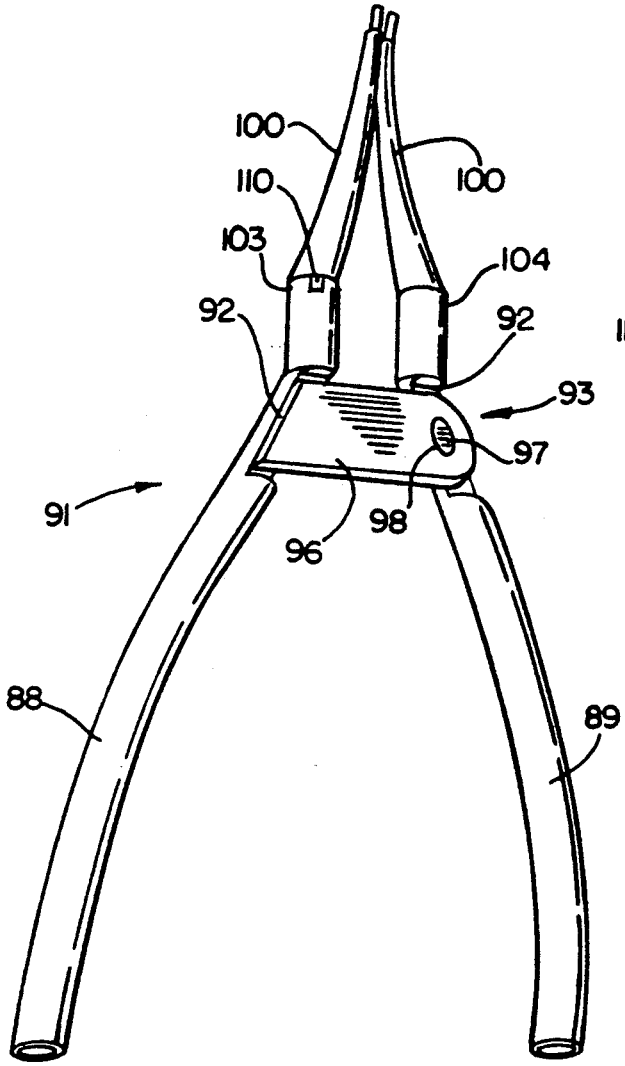
FIG. 16 is a perspective view of another form of external ring tool with replaceable jaws in accordance with invention.

In the case of the external retaining ring tool 91 shown in FIG. 16, the tubular handles 88, 89 may be pivotally connected together by welding a pivot plate 96 to the flattened portion 92 of one of the handles 88 and pivotally connecting the other handle 89 to the pivot plate 96 by means of a rivet 97 passing through aligned openings 98 therein.

Figure 11:
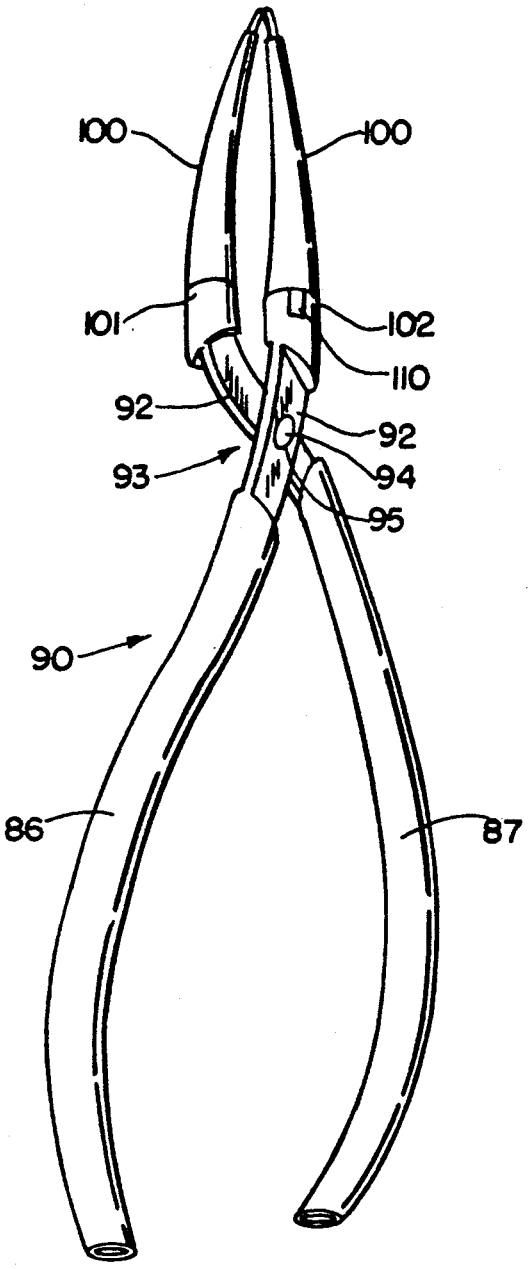
FIG. 11 is a perspective view of another form of internal ring tool with replaceable jaws in accordance with the present invention.

Interchangeable jaws 100, each having substantially the same configuration as the jaws 12 previously described, may also be interchangeably used with both the internal and external retaining ring tools 90, 91 shown in FIGS. 11 and 16. Moreover, the jaws 100 are desirably frictionally retained within the respective ends 101–104 of the tubular handles 86 through 89 using substantially the same type of corrugated tolerance rings 68 previously described. That is, tolerance rings 68 of the desired dimension and length are inserted into the respective tubular handle ends 101–104 at a sufficient depth so that when the cylindrical extensions 105 on the respective jaws 100 are completely inserted into such tubular ends, the smaller diameter portions 106 of the cylindrical extensions will engage the tolerance rings 68 to form a tight tolerance fit therebetween and the larger diameter portions 107 will closely mate with the inner diameter of the tubular walls outwardly of the tolerance rings to provide additional support for the jaws (see FIGS. 12 and 13).

Figure 13:
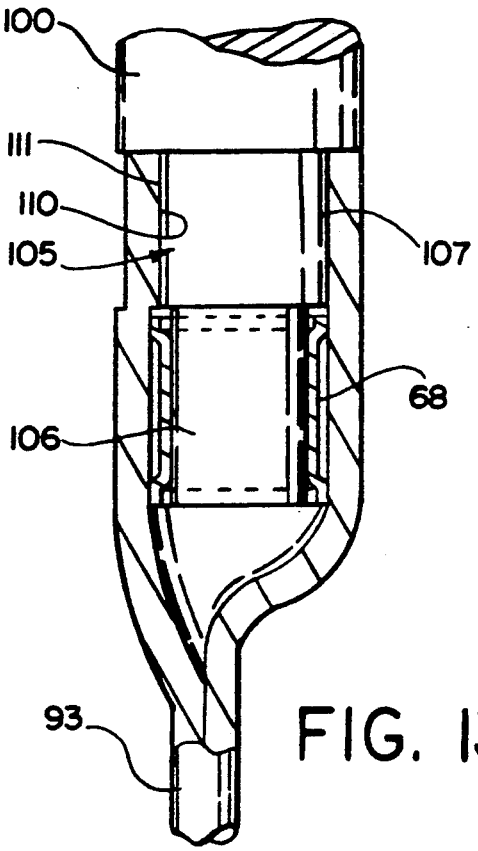
FIG. 13 is an enlarged fragmentary longitudinal section through the tool handle and jaw of FIG. 12 after assembly.
Figure 14:
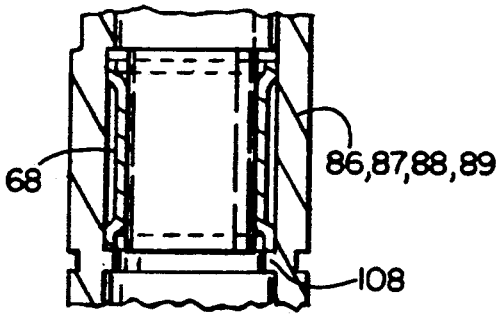
FIGS. 14 and 15 are enlarged fragmentary longitudinal sections through a portion of a tool handle and jaw similar to FIG. 13 but showing alternate ways of locating a tolerance ring within the tool handles.
Figure 15:
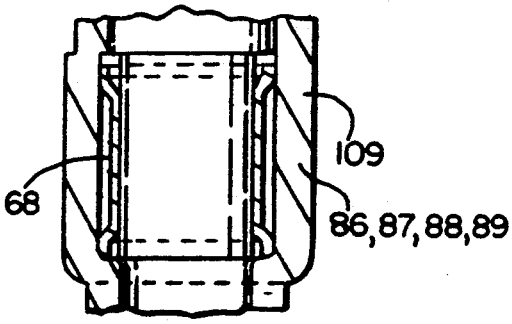

The tolerance rings 68 may be located at the desired distance from the axial outer ends of the tubular handles 86 through 89 in various ways, for example, by rolling or crimping a positive stop ring 108 on the outer diameter of the tubular handles as schematically shown in FIG. 14, or by providing an expanded tube end 109 of the desired dimension and length on the tubular handles as schematically shown in FIG. 15. However, the preferred way of locating the tolerance rings 68 in the tubular handle ends 101–104 is to maintain the tubing inner diameter full and straight for the required length and then taper the tubing down to the flattened pivot areas 93 as schematically shown in FIG. 13.

Suitable indicia may be provided for correctly indexing or orienting the jaws 100 relative to the tool handles 86 through 89 with respect to either internal or external use while at the same time providing added resistance to turning of the jaws 100 within the tubular handles. In the two tool configurations shown in FIGS. 11 and 16, this is achieved by providing a single anti-rotation flat 110 on the opposite side of the respective handle ends 101, 102 and 103, 104 for engagement by a correspondingly shaped flat 111 on the larger diameter portions 107 of the cylindrical extensions 105 on each of the jaws 100.

Figure 12:
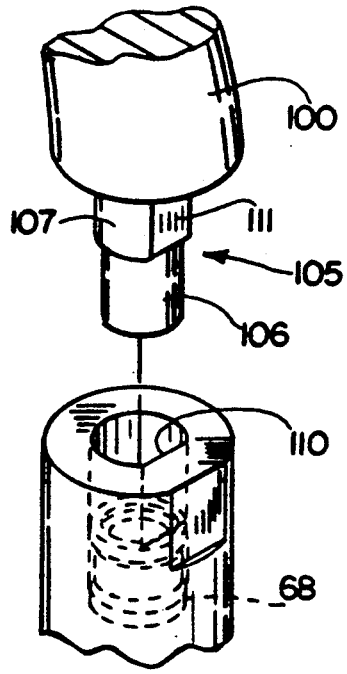
FIG. 12 is an enlarged fragmentary exploded view of one of the tool handles and jaws of FIG. 11 indicating their mating surfaces.

As schematically shown in FIGS. 12 and 13, the flat 110 in each tubular end 101–104 is desirably located closely adjacent the outermost ends thereof to provide the desired engagement with the corresponding flats 111 on the larger diameter jaw extensions 107 without interfering with the positioning of the tolerance rings 68 within the tubular ends axially inwardly of the flats 110. Also, the flats 110 and tolerance rings 68 should desirably be sized such that the tolerance rings 68 can easily be compressed to clear the flats 110 during insertion of the tolerance rings 68 into the tube ends, but once inserted, the flats 110 will help retain the tolerance rings 68 in the tube ends during removal of the jaws 68 therefrom.

Figure 17:
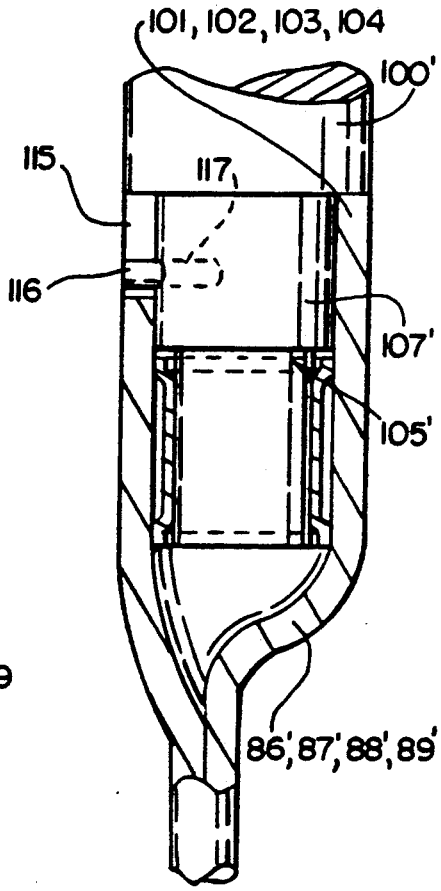
FIG. 17 is an enlarged fragmentary longitudinal section through a tool handle and jaw similar to FIG. 13 but showing an alternate way than that shown in FIG. 13 for orienting the jaw with respect to the tool handle.

Alternatively, a single slot 115 may be provided in the respective tubular ends 101, 102 and 103, 104 on opposite sides thereof for engagement by a key 116 on the same side of the larger diameter portion 107' of each jaw extension 105' for use in accurately orienting and aligning the jaws 100' and tool handles 86'–89' while preventing relative rotation therebetween in lieu of the flats 110, 111 previously described. To form each key 116, a small hole 117 may be drilled in the side of the larger diameter portion 107' of each jaw extension 105' for receipt of a small spiral pin or roll pin 116 which extends outwardly therefrom an amount slightly greater than the tubing wall thickness for mating engagement within a narrow machined slot 115 in the end of the tubing as schematically shown in FIG. 17.

From the foregoing, it will now be apparent that if a jaw breaks or otherwise becomes unusable, that jaw may be easily removed and replaced with a like jaw. Similarly, jaws may be switched between tool bodies quickly providing jaws suitable for multiple applications. This results in a reliable, relatively low cost tool or tool set wherein jaws may easily and quickly be replaced or interchanged as necessary.

While the invention is described above in relation to tools for retaining rings, it will be appreciated by one skilled in the art that the invention is equally applicable to many plier-like tool designs subjected to reasonable stresses where jaw breakage may be severe. Likewise, while the jaws are depicted as substantially planar, the invention applies also to other designs, such as jaws with 45° or 90° bends.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A retaining ring tool comprising a tool body including a pair of handles having a common pivotal axis, a pair of replaceable jaws having ring engaging tips at one end and cylindrical extensions at another end, said handles having ends containing cylindrical bores for receipt of said cylindrical extensions, tolerance ring means for frictionally retaining said cylindrical extensions in said bores, and orienting means for orienting said jaws relative to said handles.

2. The tool of claim 1 wherein said handles are made of a relatively low quality forged steel, and said jaws are made of a relatively high quality forged steel.

3. The tool of claim 1 wherein said orienting means comprises markings on said jaws and said handles to indicate proper orientation of said jaws relative to said handles.

4. The tool of claim 1 wherein said orienting means includes cooperating key and slot means on said jaws and handles.

5. The tool of claim 4 wherein said cooperating key and slot means comprises a single key on one side of said jaws and cooperating slot means on one side of one of said handles and on the opposite side of the other of said handles.

6. The tool of claim 1 further comprising cooperating key and slot means in said jaws and handles for preventing turning of said jaws with respect to said handles under high torque loads.

7. The tool of claim 6 wherein said key and slot means comprises a key on said jaws and a slot in each of said handles for receipt of said keys on said jaws.

8. The tool of claim 7 wherein said keys are only on one side of each of said jaws, and said slots are on opposite sides of said handles for orienting said jaws relative to said handles.

9. The tool of claim 1 wherein said bores have a substantially uniform diameter throughout their length, and cylindrical extensions on said jaws include reduced diameter outer end portions which frictionally engage said tolerance ring means in said bores, and larger diameter inner end portions in close sliding receipt in said bores axially outwardly of said tolerance ring means.

10. The tool of claim 1 further comprising a single keyway in each of said handles intersecting said bores axially outwardly of said tolerance ring means, and a single key on each of said larger diameter inner end portions of said cylindrical extensions for receipt in said keyways.

11. A retaining ring tool comprising a tool body including a pair of handles having a common pivotal axis, a pair of replaceable jaws having ring engaging tips at one end and cylindrical extensions at another end, said handles being made of thin wall tubing and said jaws being made of forged steel, said thin wall tubing having ends containing bores for receipt of said cylindrical extensions, retaining means for frictionally retaining said cylindrical extensions in said bores, and orienting means which are different from said retaining means for orienting said jaws relative to said handles.

12. The tool of claim 11 wherein said orienting means includes cooperating flats on said jaws and handles.

13. The tool of claim 12 wherein there is a single flat on one side of said jaws and a cooperating flat on one side of one of said handles and on the opposite side of the other of said handles.

14. The tool of claim 13 wherein said cylindrical extensions on said jaws include reduced diameter outer end portions which frictionally engage said retaining means in said bores axially inwardly of said flats on said handles, and larger diameter inner end portions in close sliding receipt in said bores axially outwardly of said retaining means, said flats on said jaws being on said larger diameter inner end portions.

15. The tool of claim 12 wherein said retaining means comprises a tolerance ring which is retained in said bores by said flats on said handles.

16. The tool of claim 11 wherein said retaining means comprises a tolerance ring located in said bores by inwardly tapering said tubing axially inwardly of said tolerance ring.

17. The tool of claim 11 wherein said retaining means comprises a tolerance ring located in each of said bores by rolling or crimping a positive stop ring in said tubing axially inwardly of said tolerance ring.

18. The tool of claim 11 wherein said retaining means comprises a tolerance ring located in each of said bores by expanding said tubing to receive said tolerance ring.

19. The tube of claim 11 wherein said orienting means includes cooperating key and slot means on said cylindrical extensions and handles.

20. In combination, a pair of removable jaws interchangeable between different types of retaining ring tools, said jaws having ring engaging tips at one end and cylindrical extensions at another end, and each of said tools including a tool body having a pair of handles pivotally connected together, said handles having ends containing bores for receipt of said cylindrical extensions on said jaws, tolerance ring means for frictionally retaining said cylindrical extensions in said bores, orienting means on one type of said tools for orienting said jaws in one orientation with respect to said handles of said one type of said tools, and other orienting means on another type of said tools for orienting said jaws in a different orientation with respect to said handles of said other type of said tools than said one orientation.

21. The combination of claim 20 wherein said one type of said tools is an internal retaining tool having said ends which move toward each other during movement of said handles toward each other, said another type of said tools is an external retaining ring tool having said ends which move away from each other during movement of said handles toward each other, and said orienting means and said other orienting means include means on said jaws and said different types of said tools for orienting said jaws on said internal retaining ring tool in a different orientation than on said external retaining ring tool.

22. The combination of claim 21 wherein each of said jaws and tips are substantially identical and include outer curved surfaces that face each other when said orienting means on said jaws and said external retaining ring tool are oriented with respect to each other, and said jaws and tips have inner curved surfaces that face each other when said other orienting means on said jaws and said internal retaining ring tool are oriented with respect to each other.

23. The combination of claim 20 wherein said tools are made of a relatively low quality forged steel and said jaws are made of a relatively high quality forged steel.

24. The combination of claim 20 wherein said orienting means and said other orienting means comprise markings on said jaws and said handles of said different types of said tools to indicate proper orientation of said jaws with respect to said different types of said tools.

25. The combination of claim 20 further comprising key and slot means on said jaws and said handles for preventing turning of said jaws with respect to said handles of said different types of said tools under high torque loads.

26. The combination of claim 25 wherein said key and slot means comprises a single key on each of said jaws and a single slot in each of said handles of said different types of said tools for receipt of said key on said jaws.

27. The combination of claim 26 wherein said key extends only from one side of said jaws, and said slots are on different sides of said handles of said different types of said tools for orienting said jaws relative to said handles of said different types of said tools.

28. The combination of claim 20 wherein said cylindrical extensions on said jaws include reduced diameter outer end portions having a friction fit in said tolerance ring means in said bores, and a larger diameter inner end portion in close sliding receipt in said bores axially outwardly of said tolerance ring means.

29. The combination of claim 28 further comprising a single keyway in each of said handles intersecting one side only of each of said bores axially outwardly of said tolerance ring means on opposite sides of said handles of said different types of said tools, and a single key on said larger diameter inner end portion of said cylindrical extension of each of said jaws for receipt in the respective keyway.

30. In combination, a pair of removable jaws interchangeable between a plurality of retaining ring tools, said jaws having ring engaging tips at one end and cylindrical extensions at another end, and each of said tools including a tool body having a pair of handles pivotally connected together, said handles being made out of thin wall tubing and said jaws being made of forged steel, said thin wall tubing having ends containing bores for receipt of said cylindrical extensions on said jaws, retaining means for frictionally retaining said cylindrical extensions in said bores, and orienting means for orienting said jaws with respect to said handles.

31. The combination of claim 30 wherein said orienting means including cooperating flats on said jaws and handles.

32. The combination of claim 31 wherein said retaining means comprises a tolerance ring which is retained in said bores by said flats on said handles.

33. The combination of claim 30 wherein said retaining means comprises a tolerance ring located in said bores by inwardly tapering said tubing axially inwardly of said tolerance ring.

34. The combination of claim 30 wherein said orienting means includes cooperating key and slot means on said cylindrical extensions and handles.

* * * * *